US010760352B2

(12) United States Patent
Savage

(10) Patent No.: US 10,760,352 B2
(45) Date of Patent: Sep. 1, 2020

(54) ROTOR CATCH ASSEMBLY

(71) Applicant: Halliburton Energy Services, Inc., Houston, TX (US)

(72) Inventor: John Keith Savage, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 249 days.

(21) Appl. No.: 15/754,190

(22) PCT Filed: Oct. 19, 2015

(86) PCT No.: PCT/US2015/056225
§ 371 (c)(1),
(2) Date: Feb. 21, 2018

(87) PCT Pub. No.: WO2017/069730
PCT Pub. Date: Apr. 27, 2017

(65) Prior Publication Data

US 2018/0291693 A1 Oct. 11, 2018

(51) Int. Cl.
*E21B 17/03* (2006.01)
*E21B 4/02* (2006.01)
*E21B 41/00* (2006.01)

(52) U.S. Cl.
CPC ..... *E21B 17/03* (2013.01); *E21B 4/02* (2013.01); *E21B 41/0021* (2013.01)

(58) Field of Classification Search
CPC ..... E21B 17/03; E21B 41/0021
See application file for complete search history.

(56) References Cited

U.S. PATENT DOCUMENTS 3,136,368 A * 6/1964 Wents ..... E21B 21/10 166/320
3,410,355 A 11/1968 Garrett
(Continued)

FOREIGN PATENT DOCUMENTS

CA 2780515 12/2013
EP 2845990 3/2015
(Continued)

OTHER PUBLICATIONS

Cavo Drilling Motors, "Motor Operations Manual", CAVO Drilling Motors, Fourth Edition (4.3), 2015, 132 pages.
(Continued)

*Primary Examiner* — William D Hutton, Jr.
*Assistant Examiner* — Steven A MacDonald
(74) *Attorney, Agent, or Firm* — Kilpatrick Townsend & Stockton LLP

(57) ABSTRACT

A catch assembly is provided for a downhole motor assembly of a drilling system. The catch assembly may include a catch basket that may be coupled to a saver sub. The saver sub may be coupled to a stator tube housing a rotor of a downhole motor. The rotor knob may be coupled to the rotor and include a flange that may be positioned in the catch basket. The flange may be positioned uphole of an internal shoulder of the catch basket. Subsequent to a connection failure in or near the stator tube, the flange may engage the internal shoulder of the catch basket to prevent the rotor from falling downhole.

18 Claims, 6 Drawing Sheets

(56) References Cited

U.S. PATENT DOCUMENTS

| | | | | |
|---|---|---|---|---|
| 5,165,492 | A * | 11/1992 | Beasley | E21B 4/02 175/107 |
| 6,145,602 | A | 11/2000 | Kutinsky | |
| 6,827,160 | B2 | 12/2004 | Blair et al. | |
| 7,063,175 | B1 * | 6/2006 | Kerstetter | E21B 17/03 175/107 |
| 7,234,545 | B2 | 6/2007 | Piñol et al. | |
| 7,445,061 | B1 | 11/2008 | Falgout, Sr. et al. | |
| 8,025,110 | B2 | 9/2011 | Falgout, Jr. et al. | |
| 8,869,917 | B2 | 10/2014 | LeBlanc et al. | |
| 8,881,835 | B2 | 11/2014 | Tate et al. | |
| 2010/0314172 | A1 | 12/2010 | Underwood et al. | |
| 2012/0193089 | A1 | 8/2012 | Makelki et al. | |
| 2012/0205158 | A1 | 8/2012 | Barnes et al. | |
| 2012/0228035 | A1 | 9/2012 | Gillis | |
| 2014/0041943 | A1 * | 2/2014 | Lanning | E21B 4/02 175/57 |
| 2014/0060936 | A1 | 3/2014 | Connell et al. | |
| 2014/0131105 | A1 * | 5/2014 | Baugher | E21B 4/003 175/55 |
| 2014/0332275 | A1 * | 11/2014 | Murray | E21B 4/02 175/57 |
| 2015/0068810 | A1 | 3/2015 | Altimas | |

FOREIGN PATENT DOCUMENTS

| | | |
|---|---|---|
| WO | 2013074865 | 5/2013 |
| WO | 2014126889 | 8/2014 |

OTHER PUBLICATIONS

Cougar Drilling Solutions, "Motor Operations Handbook", Cougar Drilling Solutions, Version 5.0, 2012, 179 pages.

International Patent Application No. PCT/US2015/056225, "International Search Report and Written Opinion", Jul. 12, 2016, 15 pages.

Canadian App. CA 2,997,210 , "Office Action", Dec. 11, 2018, 4 pages.

United kingdom Patent Application No. 1614516.1, Combined Search and Examination Report dated Feb. 2, 2017, 6 pages.

United kingdom Patent Application No. 1614516.1, Office Action dated May 16, 2018, 3 pages.

* cited by examiner

ROTOR CATCH ASSEMBLY

TECHNICAL FIELD

The present disclosure relates generally to drilling motors and, more particularly (although not necessarily exclusively), to assemblies and methods for catching a rotor in a downhole motor assembly.

BACKGROUND

A downhole motor may utilize fluid energy converted to mechanical energy to provide shaft rotation to a drill string or drill bit. The downhole motor may include a power section having a rotor operating within a stator. Because the stator is a highly loaded section of a drilling tool during operation of the downhole motor, connections within and near the stator may be prone to failure. Failure of the stator connections may result in the separation of components and a risk that these components may be lost downhole. The lost components dropped downhole may prevent further progression in drilling and can cause significant delays. In some instances, the loss of components downhole may even result in a drilling project being abandoned. A procedure known as "fishing" is sometimes used to retrieve the lost components, but this procedure is costly and time-consuming, and may be ineffective.

DETAILED DESCRIPTION

Figure 1:
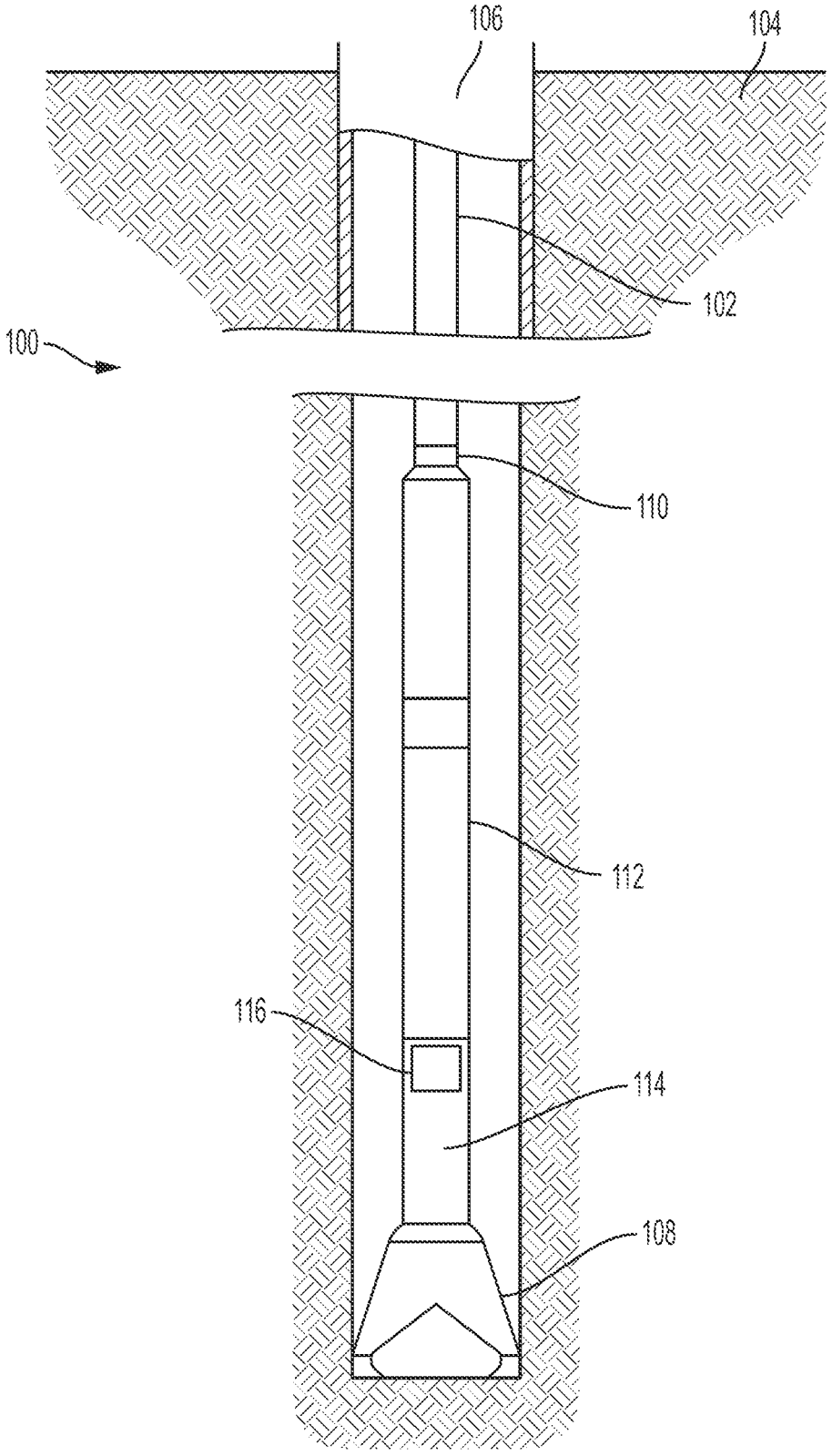
FIG. 1 is a cross-sectional schematic diagram depicting a drilling system that includes a catch assembly in a downhole motor assembly according to one aspect of the present disclosure.

Certain aspects and examples of the present disclosure relate to a downhole motor assembly including a catch assembly to prevent a loss of the rotor downhole subsequent to a connection failure or downhole motor failure in or proximate to a stator. In some aspects, the catch assembly may include a catch basket. The catch basket may be a component of the catch assembly capable of interfering with a portion of the rotor to retain the rotor in a tube of a stator. For example, the catch basket may include an internal shoulder sized to interfere with a rotor knob in the event of a failure of a stator connection downhole of the catch basket and prevent the rotor from exiting the stator tube. In additional aspects, the catch basket may also include an uphole end that may be coupled to an interior surface of a saver sub to retain the rotor in the event of a connection failure between the stator and the saver sub. A downhole portion of the catch basket including the internal shoulder may extend downhole of the saver sub into a stator tube of the stator. The stator tube may be coupled to the saver sub at a connection point downhole of the connection point of the saver sub and the catch basket.

The rotor knob may include a flange on an uphole portion of the rotor knob and a threaded end on the downhole portion of the rotor knob for coupling to an uphole end of the rotor positioned in the stator. The flange of the rotor knob may be positioned uphole of the internal shoulder. The body of the rotor knob may extend to the threaded end of the rotor knob positioned downhole of the internal shoulder. In the event of a connection failure or motor failure downhole of the catch basket, the rotor may attempt to exit the stator and fall downhole. The internal shoulder of the catch basket may be sized to interfere with the flange of the rotor knob to prevent the loss of the rotor downhole. In the event of a failure at the connection point of the saver sub and the stator tube, the rotor may be maintained by the connection of the catch basket to the saver sub uphole of the connection point of the save sub and the stator tube.

The use of a catch assembly in a downhole motor assembly may result in savings by the reduction of the replacement costs for drilling components that may otherwise be lost downhole. The catch basket may be easily coupled to the saver sub and serve to prevent the loss of expensive drilling components (e.g., the rotor) in the event of connection failures not only downhole of the internal shoulder of the catch basket, but also in the event of a connection failure between the stator tube and the saver sub. Savings may further be realized in the time and labor costs by the reduction in fishing expeditions to retrieve separated components and the resulting delays in drilling operations in performing such fishing expeditions.

The terms "inner," "outer," "internal," "external," "interior," "exterior," and "between," as used in the present disclosure may refer to a radial orientation toward or away from the center of the mud motor drilling assembly unless otherwise stated. The terms "uphole," "downhole," "above," and "below," as used in the present disclosure may refer to an axial orientation toward or away from the surface unless otherwise stated.

Various aspects of the present disclosure may be implemented in various drilling systems. FIG. 1 illustrates an example of such a drilling system 100 that includes a drill string 102. The drill string 102 of a drilling rig (not shown) may include segmented pipes that may extend below the surface 104 in a borehole, such as a wellbore 106. The drill string 102 may transmit drilling fluid (or mud) and the torque necessary to operate a drill bit 108. Also, the weight of the drill string 102 may provide an axial force on the drill bit 108. The drill string 102 may include a drill pipe 110 and a bottom hole assembly 112. The bottom hole assembly 112 may be include various components, such as a downhole motor assembly 114 and the drill bit 108 at a downhole end of the drill string 102. In some aspects, the downhole motor assembly 114 may include a downhole motor having a power section. The power section may include a rotor housed in a stator. The rotor may be connected to the drill bit 108 via a driveshaft. Though placement of the assemblies disclosed herein may vary without departing from the scope of the present subject matter, the assemblies of the present disclosure may be included in the downhole motor assembly 114. For example, the functional block in the downhole motor assembly 114 in FIG. 1 may represent a placement of the catch assembly 116 according to one example.

Figure 2:
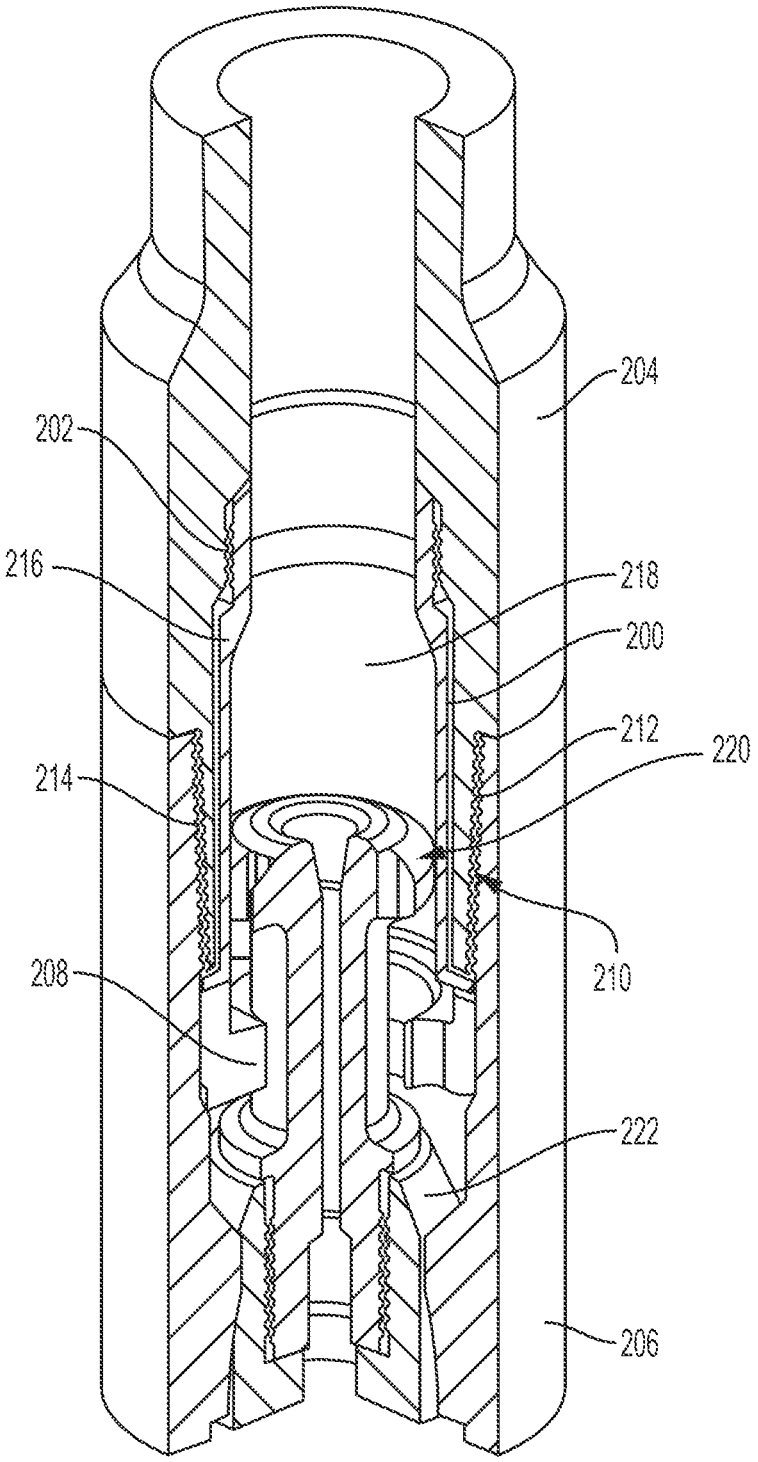
FIG. 2 is a partial perspective view of a downhole motor assembly having a catch assembly according to one aspect of the present disclosure.

FIG. 2 shows a partial cross-sectional view of a catch assembly 116 that may be positioned in the downhole motor assembly 114 of the drilling system 100 of FIG. 1, according to one example. The catch assembly 116 includes a catch basket 200. The catch basket 200 may be a container-like component of the catch assembly 116 that is sized and positionable in the catch assembly 116 to retain components (e.g., a rotor) positioned proximate to or downhole of the catch assembly 116. The catch basket 200 includes a threaded end 202 on an uphole portion of the catch basket 200 that may be mated with corresponding threads on a saver sub 204 to couple to the catch basket 200 to the saver sub 204. The saver sub 204 may be coupled to a stator tube 206 of a stator of the downhole motor assembly 114. The stator tube 206 may be positioned downhole of the saver sub 204. The catch basket 200 may be positioned internal to the saver sub 204 and the stator tube 206. For example, the threaded end 202 of the catch basket 200 may be coupled to an interior surface of the saver sub 204.

The catch basket 200 may extend downhole below the end of the saver sub 204 into the stator tube 206. The catch basket 200 may include an internal shoulder 208 extending from an interior surface of the catch basket 200. The internal shoulder 208 of the catch basket 200 may be positioned internal to the stator tube 206 and downhole of the saver sub 204 when the catch basket 200 is assembled in the catch assembly 116. The saver sub 204 and the stator tube 206 may be coupled at a connection point 210 where threads 212 on the saver sub 204 are mated with threads 214 on the stator tube 206. The connection point 210 may be positioned downhole of the threaded end 202 where the catch basket 200 is coupled to the saver sub 204. The connection point 210 further may be positioned uphole of the internal shoulder 208 of the catch basket 200. The threads 212, 214 at the connection point 210 may be corresponding threads to allow the saver sub 204 and the stator tube 206 to be coupled.

The catch basket 200 may also include a body 216 having an internal surface defining a through-bore 218 internal to the catch basket 200. In some aspects, the through-bore 218 may extend from the threaded end 202 of the catch basket 200 at the uphole end of the catch basket 200 through the internal shoulder 208 at the downhole end of the catch basket 200. In additional aspects, the internal surface of the body 216 may be shaped to define portions of the through-bore 218 having varying diameters to allow and prevent varying components of the drilling assembly to pass through the catch basket 200. For example, a rotor knob 220 may be positioned in the through-bore 218 of the catch basket 200. The rotor knob 220 may be coupled to an uphole end of a rotor 222. In some aspects, at least a portion of the through-bore 218 may include a diameter large enough to allow the rotor knob 220 to pass into the catch basket 200. A portion of the rotor knob 220 may remain internal to the catch basket 200 when the rotor knob 220 is coupled to the rotor 222. The rotor 222 may be positioned internal to the stator tube 206 and downhole of the saver sub 204 and the catch basket 200.

Figure 3:
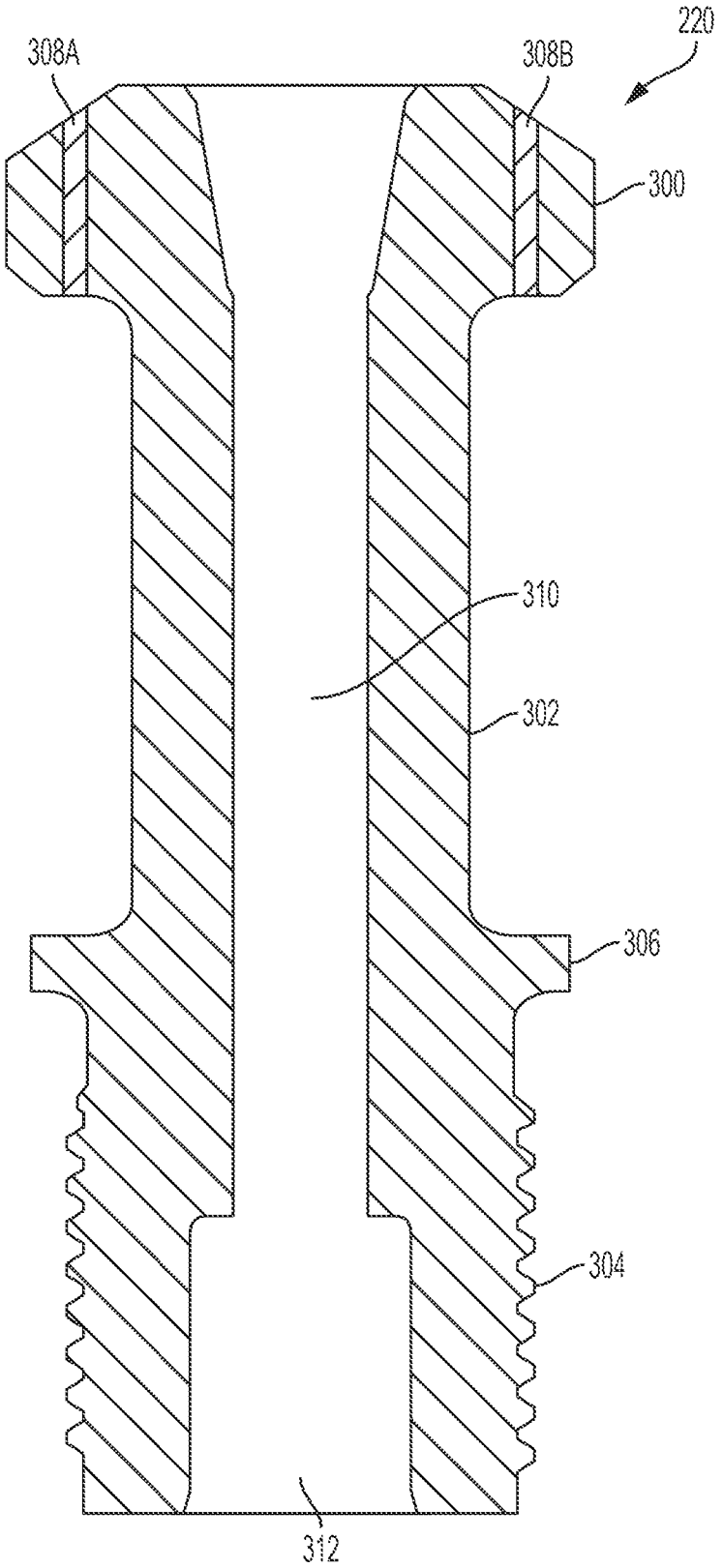
FIG. 3 is a cross-sectional view of a rotor knob of the catch assembly of FIG. 2 according to one aspect of the present disclosure.

FIG. 3 is a cross-sectional view of the rotor knob 220 according to one example. The rotor knob 220 includes a flange 300 and a body 302. The flange 300 may be positioned at an uphole end of the rotor knob 220. The flange 300 may include a diameter that is greater than a diameter of the body 302. In some aspects, the flange 300 may form a bulbous portion of the rotor knob 220. The body 302 of the rotor knob 220 may include a threaded end 304 and a shoulder 306 at a downhole portion of the rotor knob 220. The threaded end 304 may include threads corresponding to threads in the uphole end of the rotor 222 shown in FIG. 2 to couple the rotor knob 220 to the rotor 222. In some aspects, the threaded end 304 may be nose-loaded such that the shoulder 306 may protect the threads on the threaded end 304 from impingent damage. In additional and alternative aspects, the shoulder 306 may engage the uphole end of the rotor 222 when threads on the threaded end 304 of the rotor knob 220 are fully mated with the corresponding threads on the rotor 222. The flange 300 of the rotor knob 220 may include grooves 308A, 308B. In some aspects, the grooves 308A, 308B may be sized and positioned to engage a wrench. The wrench may be positioned in the grooves 308A, 308B and used to torque the rotor knob 220 to the rotor 222 shown in FIG. 2.

The rotor knob 220 further may include a center bore 310. The center bore 310 of the rotor knob 220 may extend through axial length of the rotor knob 220 from the flange 300 at the uphole end of the rotor knob 220 through the threaded end 304 at the downhole end of the body 302 of the rotor knob 220. In some aspects, the center bore 310 may allow drilling fluid to pass through the rotor knob 220. In some aspects, the center bore 310 of the rotor knob 220 may also include a downhole portion 312 as shown in FIG. 3. The downhole portion 312 of the center bore 310 may provide a coupling point to include a drilling component (e.g., a flow jet) downhole of the rotor knob 220. For example, in some aspects, the downhole portion 312 may include internal threads, an o-ring, or some other coupling mechanism to couple the drilling component to the rotor knob 220.

Figure 4:
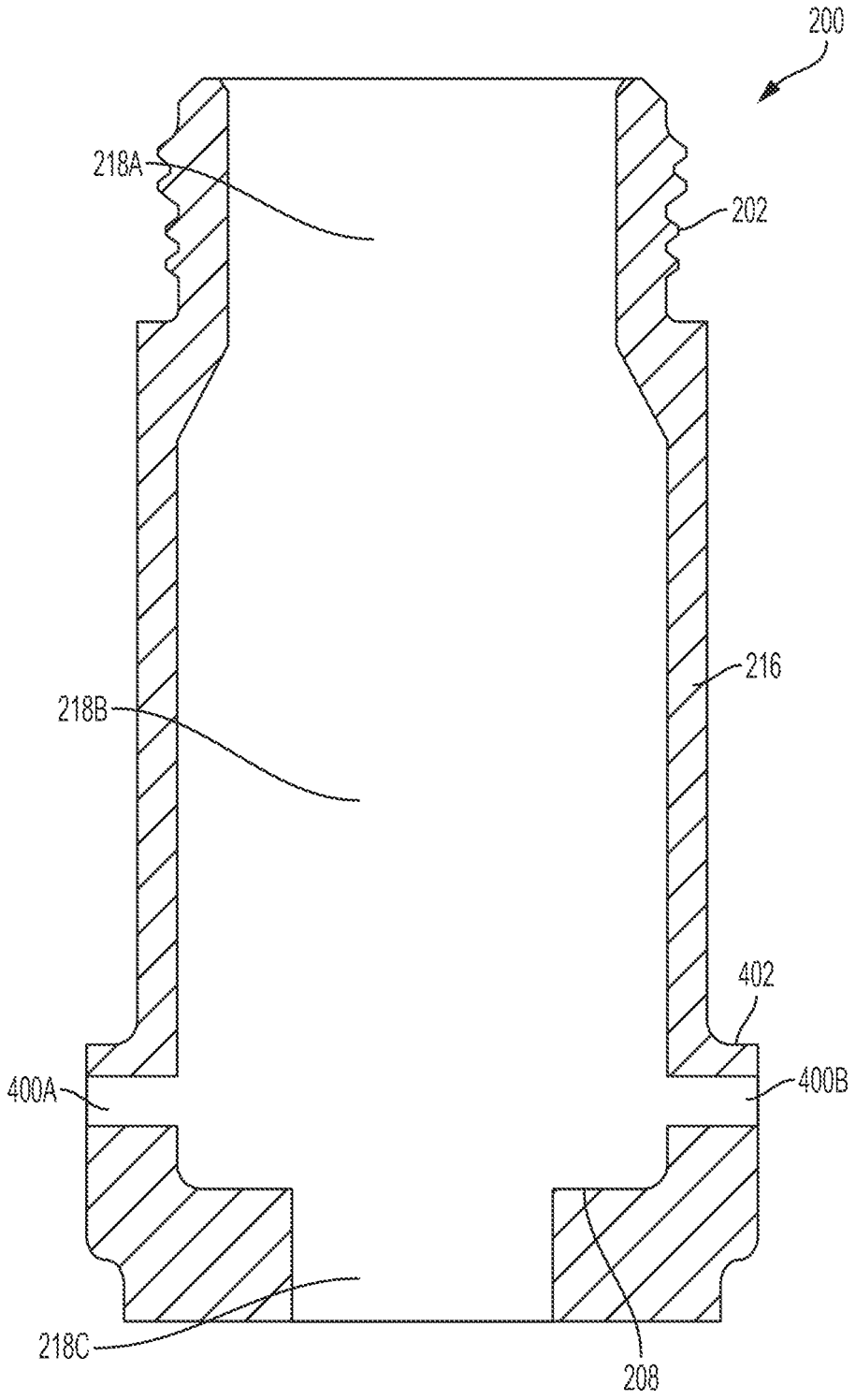
FIG. 4 is a cross-sectional view of a catch basket of the catch assembly of FIG. 2 according to one aspect of the present disclosure.

FIG. 4 is a cross-sectional view of the catch basket 200 shown in FIG. 2. The catch basket 200 includes the threaded end 202 at an uphole portion of the catch basket 200 and the internal shoulder 208 at a downhole portion of the catch basket 200. The through-bore 218 of the catch basket 200 may include portions 218A, 218B, 218C having varying diameters. For example, portion 218A of the through-bore 218 may include a diameter sized to allow the rotor knob 220 shown in FIG. 3 to pass through and into the portion 218B of the through-bore. Portion 218C of the through-bore 218 may include a diameter sized to allow the body 302 and the shoulder 306 of the rotor knob 220 to pass through and downhole of the catch basket 200, but may prevent the flange 300 of the rotor knob 220 to exit downhole of the catch basket 200.

The catch basket 200 further may include bypass ports 400A, 400B. In some aspects, the bypass ports 400A, 400B may be sized to allow fluid to exit the portion 218B of the through-bore 218. In FIG. 4, the bypass ports 400A, 400B are positioned adjacent to the internal shoulder 208 of the catch basket 200, though the position of the bypass ports 400A, 400B may vary. For example, in some aspects, the bypass ports 400A, 400B may be positioned in the internal shoulder 208 to allow fluid to pass through the portion 218B of the through-bore 218 and directly downhole of the catch basket 200. In some aspects, the bypass ports 400A, 400B may be included in the catch basket 200 to provide a passage for fluid to exit the catch basket 200. For example, drilling fluid may pass through the bypass ports 400A, 400B where a blockage impedes an exodus of the fluid through portion 218C of the through-bore 218. Although two bypass ports 400A, 400B are shown in FIG. 4, any number of bypass ports 400A, 400B may be included in the catch basket 200, including one or none, without departing from the scope of the present disclosure. The catch basket 200 may also include an external shoulder 402. The external shoulder 402 may be positioned uphole of the internal shoulder 208 on an exterior surface of the catch basket 200. The external shoulder 402 further may be positioned uphole of the bypass ports 400A, 400B.

Figure 5:
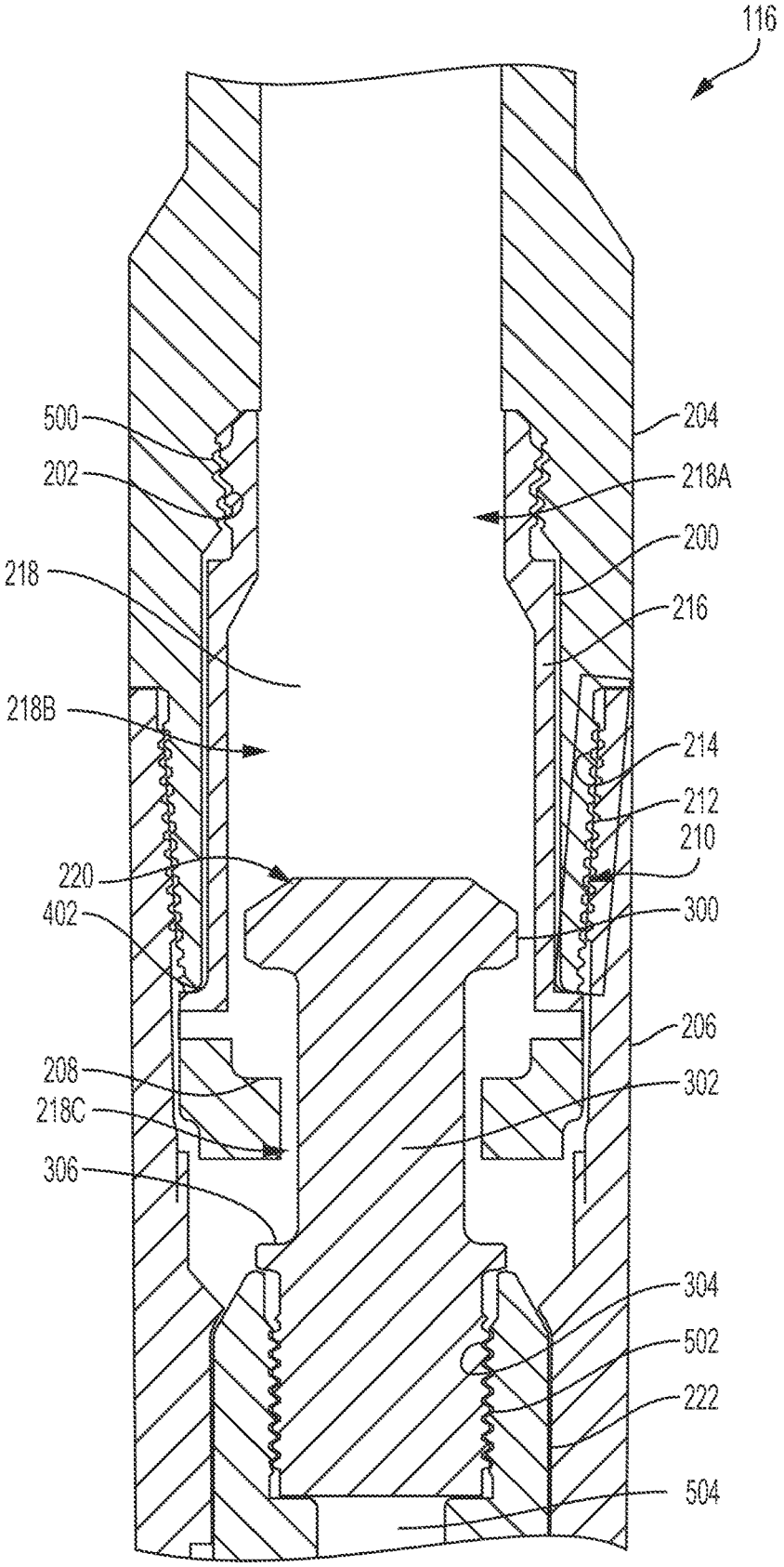
FIG. 5 is a cross-sectional view of the downhole motor assembly of FIG. 2 according to one aspect of the present disclosure.

FIG. 5 shows a cross-sectional view of the catch assembly 116 shown in FIG. 2. The threaded end 202 of the catch basket 200 may be mated with internal threads 500 on the saver sub 204 to couple the catch basket 200 to the interior surface of the saver sub 204. The exterior surface of the catch basket 200 may be positioned radially adjacent to the interior surface of the saver sub 204 downhole of the threaded end 202 of the catch basket 200 between the threaded end 202 and the external shoulder 402 of the catch basket 200. The external shoulder 402 may be shaped to correspond to a portion of the saver sub 204 proximate to the threads 212 and the connection point 210 between the saver sub 204 and the stator tube 206 at threads 212, 214. The external shoulder 402 may extend radially from the exterior surface of the catch basket 200 such that the portion of the saver sub 204 proximate to the threads is positioned axially adjacent to the external shoulder 402. The interior surface of the stator tube 206 downhole of the threads 214 may be positioned radially adjacent to the external shoulder 402 when the saver sub 204 and the stator tube 206 are coupled at the connection point 210.

The rotor knob 220 may be positioned in the through-bore 218 defined by the body 216 of the catch basket 200. The rotor knob 220 may be coupled to the rotor 222 by mating the threaded end 304 of the rotor knob 220 to internal threads 502 on the uphole end of the rotor 222. The flange 300 of the rotor knob 220 may be positioned in the portion 218B of the through-bore 218. The body 302 of the rotor knob 220 may extend from the portion 218B through the portion 218C of the through-bore to the rotor 222 positioned below the catch basket 200. The flange 300 may be positioned uphole of the internal shoulder 208. In some aspects, the body 302 of the rotor knob 220 may include an axial length to provide space in the portion 218B of the through-bore 218 between the flange 300 and the internal shoulder 208 to allow for axial movement of the rotor knob 220 in the portion 218B of the through-bore 218. The body 302 of rotor knob may further include a diameter sized to allow the body 302 to pass through the portion 218C of the through-bore 218 within the internal shoulder 208. In some aspects, the diameter of the body 302 may provide space in the portion 218C of the through-bore 218 to allow for eccentric movement of the rotor 222 during operation of the downhole motor.

In some aspects, a drilling component may be coupled to the rotor 222 downhole of the rotor knob 220. The rotor 222 may include a portion 504 for receiving the drilling component. The portion 504 may include an opening sized for the drilling component to be positioned in the rotor 222. In some aspects, the drilling component may be coupled to the rotor 222 via threading or another coupling mechanism in the downhole portion 312 of the rotor knob 220 shown in FIG. 3. In some examples, the drilling component may include a flow jet. A flow jet may be included in the rotor 222 to optimize the performance of drilling fluid flowing through the rotor 222. In one example, the rotor 222 may be included in the power section of a positive displacement or pseudo-positive displacement downhole motor operating in the wellbore 106 shown in FIG. 1. The speed of the downhole motor may be governed by the rate of flow of drilling fluid through the rotor 222. The flow jet may be coupled to the rotor 222 at portion 504 to allow additional drilling fluid to flow than the drilling fluid used to produce power to the downhole motor. The additional fluid may allow cuttings removed from the wellbore 106 by the drill bit 108 shown in FIG. 1 to be effectively floated to the surface 104 (e.g., when the drilling fluid used to produce power to the downhole motor is insufficient to float the cuttings to the surface 104).

Subsequent to a connection failure in the stator tube 206 or any other housing downhole of the connection point 210 of the stator tube 206 and the saver sub 204 shown in FIG. 5, the rotor 222 may attempt to exit the stator tube 206 and fall in a downhole direction. As the rotor 222 moves in the downhole direction, the flange 300 of the rotor knob 220 may engage the internal shoulder 208 of the catch basket 200. The internal shoulder 208 may prevent the flange 300 of the rotor knob 220, and, by extension, the rotor 222 from continuing to move in the downhole direction out of the stator tube 206, as the diameter of the flange 300 may be greater than the diameter of the portion 218C of the through-bore 218 within the internal shoulder 308. As the flange 300 of the rotor knob 220 engages the internal shoulder 208 of the catch basket 200 in the stator tube 206, a load may be passed through the rotor 222 to the rotor knob 220. The load may continue to pass from the flange 300 of the rotor knob 220 to the catch basket 200 via the internal shoulder 208. The load may then pass through the cross-section of the catch basket 200 and into the saver sub, via the threaded end 202 of the catch basket 200 and the threads 500 of the saver sub 204, to retain the rotor 222.

The catch assembly 116 of FIG. 5 may also prevent a loss of the rotor 222 downhole subsequent to a failure of the connection of the stator tube 206 to the saver sub 204 at the connection point 210. Upon a connection failure at the connection point 210 based on a failure of the threads 214 of the stator tube 206, the remains of the threads 214 may move downhole to the external shoulder 402 of the catch basket 200. A load may pass from the stator tube 206 to the catch basket 200 via the external shoulder 402. The load may then pass through the cross-section of the catch basket 200 and into the saver sub 204, via the threaded end 202 of the catch basket 200 and the threads 500 of the saver sub 204, to the retain the stator tube 206 and the rotor 222. Upon a connection failure at the connection point 210 based on a failure of the threads 212 of the saver sub 204, the stator tube 206 may move downhole, causing the rotor 222 internal to the stator tube 206 to also move downhole. As the rotor 222 moves downhole, the flange 300 of the rotor knob 220 may engage the internal shoulder 208 of the catch basket 200 and transfer a load through the cross-section of the catch basket 200 into the saver sub 204, via the threaded end 202 of the catch basket 200 and the threads 500.

Figure 6:
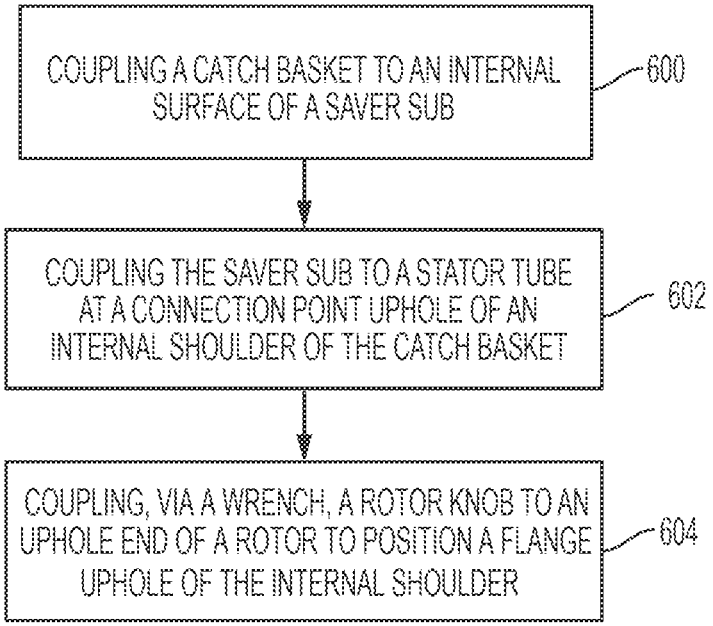
FIG. 6 is a flowchart of an example of a process for installing a catch assembly according to one aspect of the present disclosure.

FIG. 6 is a flowchart describing a process for assembling the catch assembly 116 according to one example. The process is described with respect to the catch assembly 116 shown in FIG. 5, although other implementations are possible without departing from the scope of the present disclosure.

In block 600, the catch basket 200 is coupled to an internal surface of the saver sub 204. In some aspects, the catch basket 200 and the saver sub 204 may be threadably coupled by mating the threaded end 202 of the catch basket 200 and the corresponding threads 500 on the internal surface of the saver sub 204. In some aspects, the threaded end 202 of the catch basket 200 may include male threads and the threads 500 may include female threads to allow the catch basket 200 to be coupled to the saver sub 204. In other aspects, the threaded end 202 may include female threads for mating with male threads 500. The profile of the exterior surface of the catch basket 200 may correspond to the interior profile of the saver sub such that the catch basket 200 and the saver sub 204 are positioned radially adjacent to each other between the threaded end 202 of the catch basket 200 and the external shoulder 402 of the catch basket 200. The external shoulder 402 may extend from the exterior surface of the catch basket 200 such that a portion of the saver sub 204 proximate to the threads 212 may be axially adjacent to the external shoulder 402. In some aspects, the through-bore 218 of the catch basket 200 may be aligned with a through-bore of the saver sub 204 and any additional components coupled to the drill string 102 shown in FIG. 1 uphole of the catch basket 200 to allow drilling tools and components to be positioned down-hole from the surface 104 via the through-bore 218.

In block 602, the saver sub 204 may be coupled to the stator tube 206. In some aspects, the saver sub 204 and the stator tube 206 may be threadably coupled at a connection point 210 by mating the external threads 212 on the saver sub 204 with corresponding internal threads 214 on the stator tube 206. The catch basket 200 may extend from the saver sub 204 downhole into the stator tube 206 such that the connection point 210 is positioned uphole of the internal shoulder 208 of the catch basket 200. The internal shoulder 208 may be positioned downhole of the connection point 210 and internal to the stator tube 206 as shown in FIG. 5. In some aspects, the portion 218C of the through-bore 218 may be aligned with an opening in the uphole end of the rotor 222 to allow at least a portion of the rotor knob 220 to pass through portions 218B, 218C of the through-bore 218 and into the opening in the uphole end of the rotor 222.

In block 604, the rotor knob 220 is coupled to the uphole end of the rotor 222. For example, the threaded end 304 of the rotor knob 220 may be mated with corresponding threading 502 in the uphole end of the rotor 222. In some aspects, a wrench may be lowered into the through-bore 218 of the catch basket 200 to engage the rotor knob 220. In some aspects, the wrench may be positioned in the grooves 308A, 308B of the rotor knob 220 shown in FIG. 3. The wrench may be rotated to torque the threaded end 304 of the rotor knob to the rotor 222. For example, the wrench may be rotated until the shoulder 306 of the rotor knob 220 engages the rotor 222 indicating that the rotor knob 220 is fully coupled to the rotor 222. In another example, the wrench may be rotated to nose-load the threaded end 304. The rotor knob 220 may be coupled to the rotor 222 such that the flange 300 of the rotor knob 220 is positioned in the portion 218B of the through-bore 218 of the catch basket 200 uphole of the internal shoulder 208. The body 302 of the rotor knob 220 may extend from the flange 300 positioned in the catch basket 200 to the threaded end 304 downhole of the catch basket 200 and coupled to the rotor 222.

Although the process of FIG. 6 is described in a particular order, the order of assembling the catch assembly 116 may vary without departing from the scope of the present disclosure. For example, in some aspects, the rotor knob 220 may be positioned in the catch basket 200 and coupled to the rotor 222 prior to coupling the catch basket to the saver sub 204. The rotor 222 may be pulled uphole out of the power section of the downhole motor to allow threaded end 202 of the catch basket 200 to access the internal threads 500 on the saver sub 204 and complete the catch assembly 116.

In some aspects, downhole motor assemblies are provided according to one or more of the following examples:

Example #1

A catch assembly may include a rotor knob including a flange and a knob body that has a downhole threaded end couplable to an end portion of a rotor. The catch assembly may also include a catch basket positionable internal to a saver sub and a stator tube. The catch basket may include an uphole threaded end couplable to the saver sub. The catch basket may also include an internal shoulder positionable uphole of the end portion of the rotor and downhole of a connection point between the saver sub and the stator tube. The catch basket may also include a catch basket body defining a through-bore extending from the uphole threaded end to the internal shoulder. At least one portion of the through-bore may be sized to receive the flange of the rotor knob.

Example #2

The catch assembly of Example #1 may feature the internal shoulder being sized to prevent a loss of the rotor downhole by interfering with the flange of the rotor knob.

Example #3

The catch assembly of Examples #1-2 may feature the uphole threaded end being positionable uphole of the connection point between the saver sub and the stator tube to prevent a loss of the rotor downhole subsequent to the stator tube separating from the saver sub.

Example #4

The catch assembly of Examples #1-3 may feature the flange being positionable uphole of the internal shoulder.

Example #5

The catch assembly of Examples #1-4 may feature the flange including grooves sized to engage a wrench for coupling the flange to the end portion of the rotor.

Example #6

The catch assembly of Examples #1-5 may feature the internal shoulder being positionable downhole of the saver sub and internal to the stator tube.

Example #7

The catch assembly of Examples #1-6 may feature the catch basket also including at least one bypass port proximate to the internal shoulder.

Example #8

The catch assembly of Examples #1-7 may feature the through-bore including a first portion. The first portion may be internal to the uphole threaded end and may include a first diameter. The through-bore may also include a second portion axially between the uphole threaded end and the internal shoulder. The second portion may include a second diameter. The through-bore may also include a third portion internal to the shoulder. The third portion may include a third diameter. The first diameter and the second diameter may be greater than an outer diameter of the flange to allow the flange to pass through the first portion. The third diameter may be less than the outer diameter of the flange to prevent the flange from passing through the third portion.

Example #9

A downhole motor assembly may include a rotor including an uphole end positionable internal to a downhole end of a stator tube. The downhole motor assembly may also include a rotor knob including a flange and a knob body. The flange may have a first diameter larger than a diameter of the knob body. The knob body may be couplable to the uphole end of the rotor. The downhole motor assembly may also include a saver sub couplable to the stator tube at a connection point between the saver sub and the stator tube. The downhole motor assembly may also include a catch basket. The catch basket may include an uphole end couplable to the saver sub uphole of the connection point. The catch basket may also include an internal shoulder positionable downhole of the connection point and axially between the flange of the rotor knob and the uphole end of the rotor.

Example #10

The downhole motor assembly of Example #9 may feature the internal shoulder being positionable downhole of the saver sub. The internal shoulder may be sized to prevent a loss of the rotor downhole by interfering with the flange of the rotor knob.

Example #11

The downhole motor assembly of Examples #9-10 may feature the saver sub including internal threads corresponding to external threads on the uphole end of the catch basket and positionable uphole of the connection point between the saver sub and the stator tube to prevent a loss of the rotor downhole subsequent to the stator tube separating from the saver sub.

Example #12

The downhole motor assembly of Examples #9-11 may feature the flange including grooves sized to engage a wrench for coupling the flange to the uphole end of the rotor.

Example #13

The downhole motor assembly of Examples #9-12 may feature the catch basket also including at least one bypass port proximate to the internal shoulder.

Example #14

The downhole motor assembly of Examples #9-13 may feature the catch basket further including an external shoulder positionable downhole of the connection point to receive an axial load from the stator tube subsequent to the stator tube at least partially separating from the saver sub.

Example #15

The downhole motor assembly of Examples #9-14 may feature the diameter of the knob body of the rotor knob being sized to eccentrically move within a center bore of the internal shoulder during operation of the rotor.

Example #16

The downhole motor assembly of Examples #9-15 may feature the rotor knob including a center bore to allow drilling fluid to pass between the catch basket and the rotor during operation of the rotor.

Example #17

A method may include coupling a catch basket to an interior surface of a saver sub. The catch basket may include a through-bore sized to allow a rotor knob to pass through the through-bore. The method may also include coupling the saver sub to a stator tube at a connection point uphole of an internal shoulder of the catch basket. The method may also include coupling the rotor knob to an uphole end of a rotor positioned in the stator tube to position a flange of the rotor knob uphole of the internal shoulder.

Example #18

The method of Example #17 may feature coupling the catch basket to the interior surface of the saver sub to include mating an uphole threaded end of the catch basket with internal threading on the saver sub uphole of the connection point.

Example #19

The method of Examples #17-18 may feature coupling the saver sub to the stator tube to include positioning the internal shoulder of the catch basket internal to the stator tube.

Example #20

The method of Examples #17-19 may feature coupling the rotor knob to the uphole end of the rotor to include lowering a wrench into the through-bore of the catch basket. Coupling the rotor knob to the uphole end of the rotor may also include positioning the wrench in grooves of the rotor knob. Coupling the rotor knob to the uphole end of the rotor may also include mating, via the wrench, a downhole threaded end of the rotor knob with threading on the uphole end of the rotor.

The foregoing description of the examples, including illustrated examples, has been presented only for the purpose of illustration and description and is not intended to be exhaustive or to limit the subject matter to the precise forms disclosed. Numerous modifications, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A catch assembly, comprising:

a rotor knob including a flange and a knob body that has a downhole threaded end couplable to an end portion of a rotor; and a catch basket positionable internal to a saver sub and a stator tube, the catch basket including:

an uphole threaded end couplable to the saver sub;

an internal shoulder positionable uphole of the end portion of the rotor and downhole of a connection point between the saver sub and the stator tube;

a catch basket body defining a through-bore extending from the uphole threaded end to the internal shoulder, at least one portion of the through-bore sized to receive the flange of the rotor knob; and an external shoulder positionable downhole of the connection point to receive an axial load from the stator tube subsequent to the stator tube at least partially separating from the saver sub.

2. The catch assembly of claim 1, wherein the internal shoulder is sized to prevent a loss of the rotor downhole by interfering with the flange of the rotor knob.

3. The catch assembly of claim 1, wherein the uphole threaded end is positionable uphole of the connection point between the saver sub and the stator tube to prevent a loss of the rotor downhole subsequent to the stator tube separating from the saver sub.

4. The catch assembly of claim 1, wherein the flange is positionable uphole of the internal shoulder.

5. The catch assembly of claim 1, wherein the flange includes grooves sized to engage a wrench for coupling the flange to the end portion of the rotor.

6. The catch assembly of claim 1, wherein the internal shoulder is positionable downhole of the saver sub and internal to the stator tube.

7. The catch assembly of claim 1, wherein the catch basket further includes at least one bypass port proximate to the internal shoulder.

8. The catch assembly of claim 1, wherein the through-bore includes a first portion internal to the uphole threaded end and having a first diameter, a second portion axially between the uphole threaded end and the internal shoulder and having a second diameter, and a third portion internal to the internal shoulder and having a third diameter, wherein the first diameter and the second diameter are greater than an outer diameter of the flange to allow the flange to pass through the first portion, wherein the third diameter is less than the outer diameter of the flange to prevent the flange from passing through the third portion.

9. A downhole motor assembly, comprising:

a rotor including an uphole end positionable internal to a downhole end of a stator tube;

a rotor knob including a flange and a knob body, the flange having a first diameter larger than a diameter of the knob body, the knob body couplable to the uphole end of the rotor;

a saver sub couplable to the stator tube at a connection point between the saver sub and the stator tube; and a catch basket including:

an uphole end couplable to the saver sub uphole of the connection point;

an internal shoulder positionable downhole of the connection point and axially between the flange of the rotor knob and the uphole end of the rotor; and an external shoulder positionable downhole of the connection point to receive an axial load from the stator tube subsequent to the stator tube at least partially separating from the saver sub.

10. The downhole motor assembly of claim 9, wherein the internal shoulder is further positionable downhole of the saver sub, wherein the internal shoulder is sized to prevent a loss of the rotor downhole by interfering with the flange of the rotor knob.

11. The downhole motor assembly of claim 9, wherein the saver sub includes internal threads corresponding to external threads on the uphole end of the catch basket and positionable uphole of the connection point between the saver sub and the stator tube to prevent a loss of the rotor downhole subsequent to the stator tube separating from the saver sub.

12. The downhole motor assembly of claim 9, wherein the flange includes grooves sized to engage a wrench for coupling the flange to the uphole end of the rotor.

13. The downhole motor assembly of claim 9, wherein the catch basket further includes at least one bypass port proximate to the internal shoulder.

14. The downhole motor assembly of claim 9, wherein the diameter of the knob body of the rotor knob is sized to enable the rotor knob to eccentrically move within a center bore of the internal shoulder during operation of the rotor.

15. The downhole motor assembly of claim 9, wherein the rotor knob includes a center bore to allow drilling fluid to pass between the catch basket and the rotor during operation of the rotor.

16. A method, comprising:

coupling a catch basket to an interior surface of a saver sub, the catch basket having a through-bore sized to allow a rotor knob to pass through the through-bore;

coupling the saver sub to a stator tube at a connection point uphole of an internal shoulder of the catch basket; and coupling the rotor knob to an uphole end of a rotor positioned in the stator tube to position a flange of the rotor knob uphole of the internal shoulder, wherein coupling the rotor knob to the uphole end of the rotor includes:

lowering a wrench into the through-bore of the catch basket;

positioning the wrench in grooves of the rotor knob;

mating, via the wrench, a downhole threaded end of the rotor knob with threading on the uphole end of the rotor.

17. The method of claim 16, wherein coupling the catch basket to the interior surface of the saver sub includes mating an uphole threaded end of the catch basket with internal threading on the saver sub uphole of the connection point.

18. The method of claim 16, wherein coupling the saver sub to the stator tube includes positioning the internal shoulder of the catch basket internal to the stator tube.

* * * * *